United States Patent [19]

Moraw

[11] 4,047,238

[45] Sept. 6, 1977

[54] APPARATUS AND PROCESS FOR ELECTROSTATICALLY CHARGING A RECORDING MATERIAL

[75] Inventor: Roland Moraw, Naurod, Taunus, Germany

[73] Assignee: Hoechst Aktiengesellschaft, Frankfurt am Main, Germany

[21] Appl. No.: 695,922

[22] Filed: June 14, 1976

[30] Foreign Application Priority Data

June 13, 1975 Germany ..... 2526418

[51] Int. Cl.[2] ..... H01T 19/00

[52] U.S. Cl. ..... 361/229; 250/326

[58] Field of Search ..... 361/225, 229, 230; 250/324, 325, 326

[56] References Cited

U.S. PATENT DOCUMENTS

| | | | |
|---|---|---|---|
| 2,934,650 | 4/1960 | De Witt | 250/325 |
| 2,980,834 | 4/1961 | Tregay et al. | 361/225 |
| 3,303,401 | 2/1967 | Naumann et al. | 361/229 |
| 3,723,111 | 3/1973 | Kojima et al. | 361/229 X |
| 3,739,246 | 6/1973 | Haas | 361/225 |
| 3,942,080 | 3/1976 | Milewski | 361/229 |

OTHER PUBLICATIONS

IBM Technical Disclosure Bulletin, vol. 15, No. 7, Dec. 72, p. 2060.

*Primary Examiner*—Harry E. Moose, Jr.
*Attorney, Agent, or Firm*—Richard L. Schwaab

[57] ABSTRACT

Disclosed is a process and, to implement the process, an electrostatic charging apparatus comprising means for producing a corona discharge; a counter-electrode positioned below the discharge means adapted for supporting a recording material to be charged; means for supporting the counter-electrode, including a pair of opposed vertical side walls defining a guide channel of substantially rectangular cross-section along which the recording material can pass; and a pair of elongated strip-like members of electrically insulative material extending within the channel at least from the side walls laterally along the opposed marginal regions of the counter-electrode and longitudinally along the whole length of the counter-electrode.

22 Claims, 3 Drawing Figures

APPARATUS AND PROCESS FOR ELECTROSTATICALLY CHARGING A RECORDING MATERIAL

BACKGROUND OF THE INVENTION

The present invention relates to an apparatus for electrostatically charging a recording material.

It has been proposed to record deformation images on recording materials having a photoconductive thermoplastic layer by means of the steps of electrostatic charging, imagewise exposure and heating of the layer. Deformation images of this type may be, inter alia, holograms and/or alphanumerical graphic representations.

In a known apparatus for recording deformation images on the recording material, a pliable photoconductive film is, during recording, attracted by electrostatic adhesion to a supporting surface consisting of a glass plate having thereon a conductive transparent layer. A device is provided which separates the recording material from the supporting surface by exerting a pulling action on the recording material at an acute angle to the plane of the surface. After having separated a length of processed material from the supporting surface, which material is transported through the apparatus from a supply reel, the separating device, returns to a position in which it allows build up of the electrostatic charge by guiding the recording material close to the supporting plate. For carrying out the processing steps, for example, electrostatic charging, exposure and thermal development, a control circuit has been proposed which has been modified to control erasure and rerecording steps.

The apparatus charges the recording material by means of a corona discharge device, wherein there is used as the counter-electrode a conductive, transparent layer, supported on a glass plate, over which the recording material is conveyed. The recording material itself does not contain a conductive intermediate layer. In this recording apparatus a relatively large corona voltage, i.e., between 7 and 10 kV is used. The recording material consists of, for example, a 50 μm thick carrier film of polyester having an approximately 2 μm thick photoconductive, thermoplastic layer thereon. The charging is effected over the largest possible surface area from one edge of the recording material to the other so as to ensure optimum use of the recording material for the recordings. In the case of a recording material of 35 mm width, it is desirable to achieve the usual recording width of 24 mm even when recording deformation images. In this case, however, there is the considerable disadvantage that, when charging the marginal areas of the recording material, the corona discharge frequently flashes over the edge of the recording material to the transparent, conductive layer on the glass plate. As a result the transparent, conductive layer may be damped with consequent disturbance of the control process for the series of processing steps.

SUMMARY OF THE INVENTION

It is therefore an object of the present invention to provide an improved electrostatic charging apparatus.

Another object of the invention resides in the provision of an improved apparatus for electrostatically charging a recording material, especially a thermoplastic recording material.

It is another object of the present invention to provide an improved electrostatic charging apparatus wherein the possibility of damage to the transparent, electrically conductive layer caused by flash-over is prevented or reduced.

Another object of the invention resides in the provision of a method for electrostatically charging a recording material using the improved apparatus.

It is also an object of the invention to provide an improved apparatus and process for imaging a recording material.

In accomplishing the foregoing objects, there has been provided in accordance with the present invention an electrostatic charging apparatus comprising discharge means for producing a corona discharge, a counter-electrode positioned below the discharge means for supporting recording material to be charged, means for supporting the counter-electrode, including a pair of opposed vertical side walls defining a guide channel of substantially rectangular cross-section along which the recording material can pass, and a pair of strip-like members of electrically insulative material extending within the channel at least from the side walls laterally along the opposed marginal regions of the counter-electrode and longitudinally along the whole length of the counter-electrode.

The strip-like insulating members are advantageously inserted in horizontal slots formed in the side walls of the guide channel.

In a preferred embodiment of the apparatus, the counter-electrode extends beyond the insulating members in the direction transverse to the path of movement of the recording material but, in the direction of movement of the recording material, the insulating members extend beyond the counterelectrode. In a preferred embodiment the counter-electrode comprises a transparent, electrically conductive layer. The conductive layer has extending along each longitudinal edge region thereof, an electrode, the electrodes being connectable to a heating voltage source by two leads one of which is grounded.

Further features, objects and advantages of the invention will become apparent from the following detailed description of preferred embodiments when considered in light of the accompanying drawings wherein similar or identical parts bear the same reference numerals.

DETAILED DESCRIPTION OF PREFERRED EMBODIMENTS

The apparatus of the invention has the advantage that flash-over beyond the edges of the recording material is intercepted by the insulating members, so that penetration to the transparent, conductive layer lying beneath the insulating members is substantially avoided.

Figure 1:
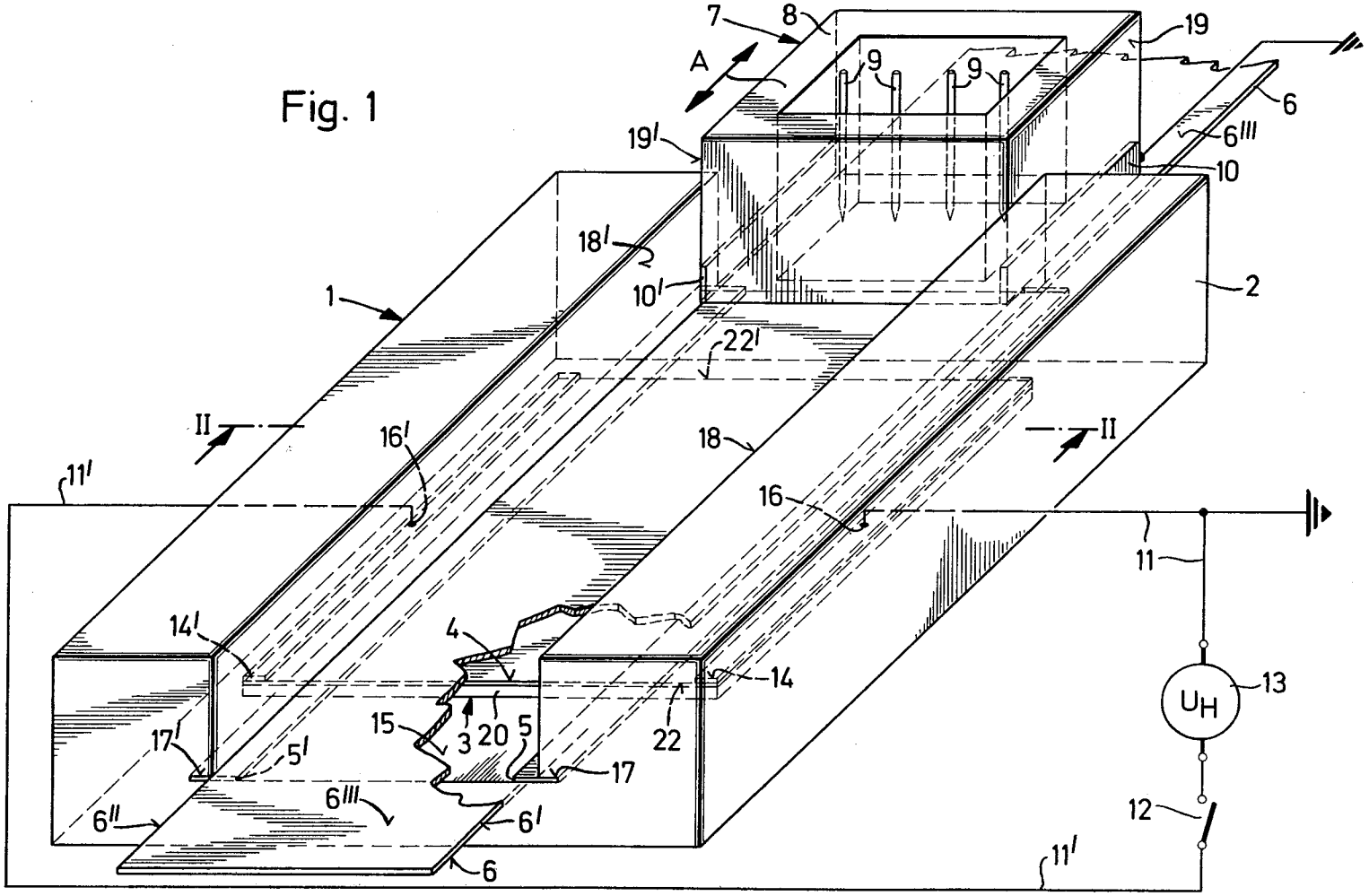
FIG. 1 is a schematic, perspective view, partially in section, of the apparatus of the present invention.

Referring to FIG. 1, the apparatus designated generally by reference numeral 1 comprises a support 2 consisting of dielectric material which accommodates a planar counter-electrode 3 and a corona discharge device 7. The quadrangular support 2 is provided with a continuous guide path 15 of rectangular cross-section through which recording material 6 to be processed runs, and along which the corona discharge device 7 can be moved back and forth in the directions of the double arrow A.

If, as is preferred, recordings are to be made by the transillumination process, the counter-electrode 3 consists of a transparent carrier plate 20, for example, a glass or quartz glass plate, to which a transparent, conductive layer 4 has been applied. The transparent, conductive layers may consist, for example, of tin oxide or copper iodide. The layer 4 faces the recording material 6. A heating voltage source 13 is connected by way of a first electric lead 11 to a first electrode 14 positioned at the edge of the conductive layer 4 and to ground, and by way of a switch 12 and a second electric lead 11' it is connected to an oppositely-lying second electrode 14' positioned at the opposite edge of the conductive layer 4. It is obviously possible for the second line 11' to be grounded instead of the first line 11. The heating voltage source 13 may be either a direct current or an alternating current source. Electrical connection points 16,16' for the electric leads 11,11' to the electrodes 14,14' are positioned inside of the support 2. The counter-electrode 3 is thus grounded by way of lead 11 or 11'. After charging by the corona discharge device 7 and exposure of the recording material 6 (the exposure means are not shown), the heat necessary for the thermal development is supplied to the layer 4 by applying briefly a heating voltage $U_H$ from the heating voltage source 13 by closing switch 12.

The recording material 6 is disposed with the uncoated side of its carrier film on the conductive layer 4 and carries on its upper side a photoconductive, thermoplastic layer 6'''. To effect electrostatic charging, the corona discharge device 7 is moved back and forth in the directions of arrow A. The corona discharge device 7 consists of a corona housing 8 containing, for example, a stretched wire high voltage electrode or, as is shown, a series of corona needles 9 to which a high voltage is applied.

The conductive layer 4 has a pair of insulating members 5,5' disposed thereon. Part of the width of each member 5,5' is accommodated in horizontal slots 17 and 17', respectively, which run along the side walls 18 and 18', respectively, of the support 2. The remaining part of the width of members 5,5' extends into guide path 15 so that during use of the apparatus the edges 6' and 6'' of the recording material 6 are separated from the conductive layer 4. The insulating members 5,5' are longer than the conductive layer 4 so that flash-over of the corona discharge in the region of the transverse edges 22,22' of the conductive layer, which are particularly susceptible to this risk, can be substantially prevented.

The walls 19,19' of the corona housing 8, which face the side walls 18, 18', are provided in their lower regions with screen electrodes 10,10' which are in the form of strips and which face and extend parallel to the side walls 18,18'.

Figure 2:
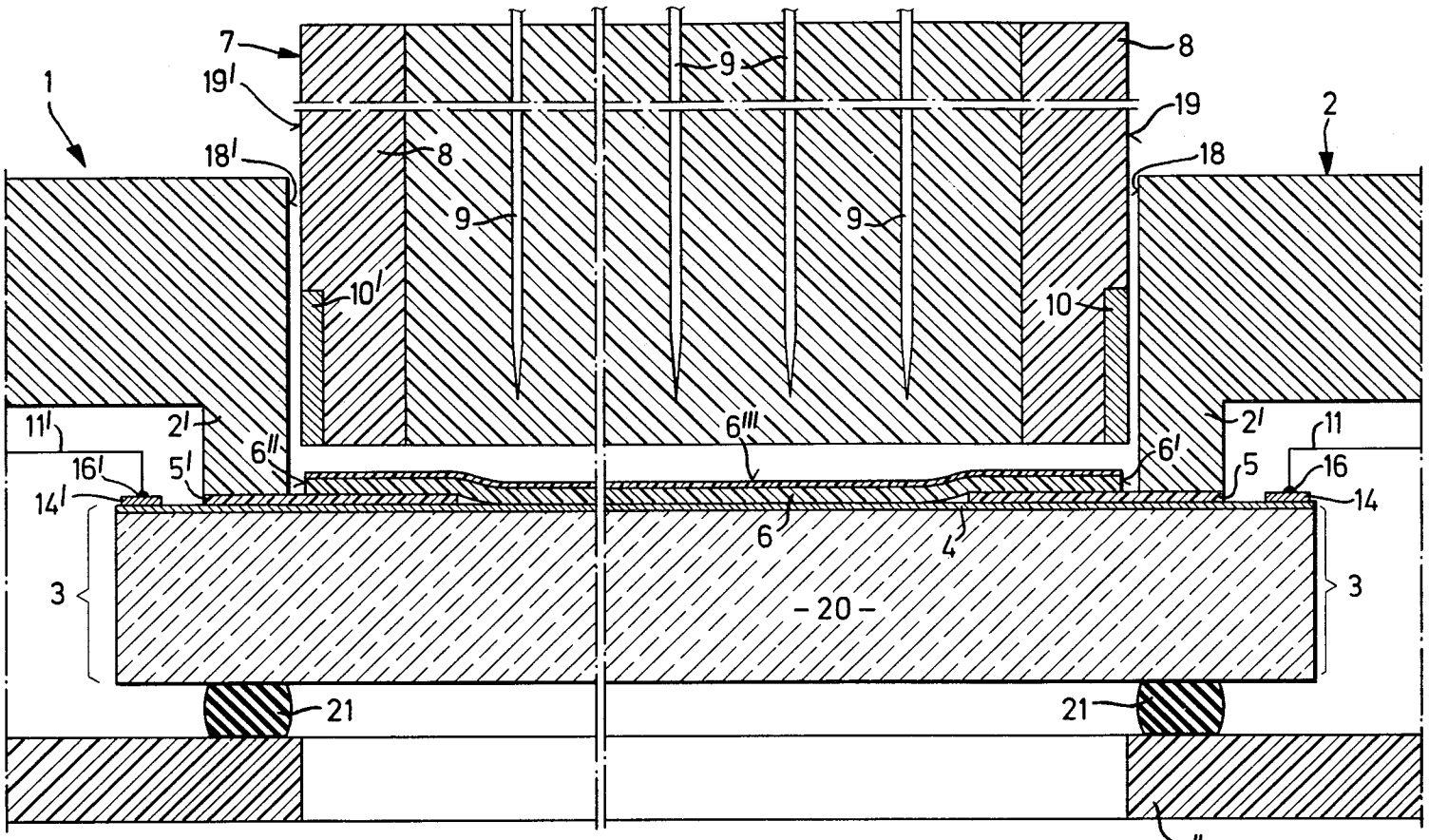
FIGS. 2 and **2*a* are enlarged fragmentary transverse vertical sectional views through slightly modified forms of the apparatus of FIG. 1**.
Figure 2A:
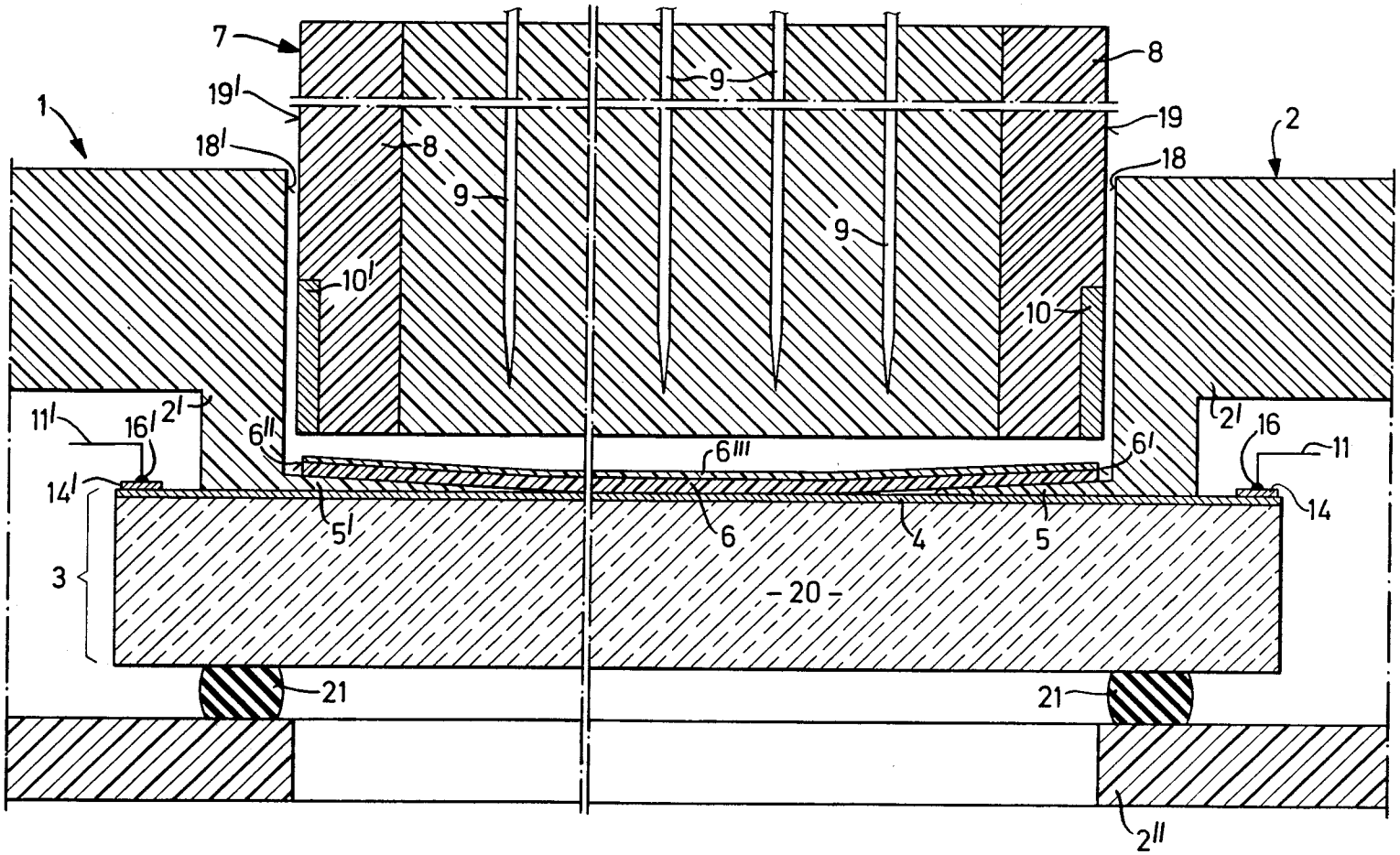

In the slightly modified embodiment shown in FIG. 2, the support 2 comprises a support member 2' of dielectric material which accommodates the counter-electrode 3 and a frame-shaped backing member 2''. The member 2'', by way of disks 21 of elastic, heat-resistant material, presses the counter electrode 3 against the support member 2'. Insulating members 5,5' are clamped in between the counter-electrode 3 and the support member 2'.

In order, during corona discharge, to prevent discharge from going past the edge of the recording material 6 directly to the conductive layer 4, the insulating members 5,5' underlying the recording material 6 and extending beyond the edges 6',6'' thereof are provided between the counter-electrode 3 and the support member 2'. The recording material 6 overlaps the insulating members 5,5' only in the marginal longitudinal zones of the recording material 6.

Tests have shown that a lapping width of between 2 mm and 5 mm renders possible a relatively penetration-free charging of the recording material 6, the reliability increasing as the overlapping width is increased. In the image area, the recording material 6 is held securely on the conductive layer 4, as a result of the electrostatic forces resulting from the charges applied to the material, so that an adhesion adequate for holographic recordings exists for all of the processing steps. The insulating members 5,5' may be projecting parts of the support member 2', that is they may be formed in one piece together with the latter, as shown in the detail in FIG. *2a*. For reasons of manufacture and because of the possibility of replacement in cases of damage, the insulating members 5,5' are, however, preferably separate, interchangeable components. It is possible to use, for example, for the insulating members 5,5' strips of an insulating film of polyester 50 μm thick which are clamped between the support member 2' and the counterelectrode 3. The insulating members 5,5' considerably improve the reliability of operation of charging devices, since flashovers during corona discharge to the transparent, conductive layer 4 of the counter-electrode 3 are substantially prevented.

The screen electrodes 10 and 10' on the corona housing 8 serve to reduce the relatively small number of flash-overs which, even after the installation of the insulating members 5 and 5', may occur under certain circumstances. The discharging distance from the corona needles 9 to the screen electrodes 10 and 10' is shorter than the discharging distance from the corona needles around the edge 6' of the recording material 6 and along the insulating member 5 to the conductive layer 4. On account of the shorter discharging distance between the corona needles 9 and the screen electrodes 10 and 10', uncontrolled discharges in the edge region are intercepted by the preferably grounded screen electrodes 10 and 10' (see Fig. 1). The screen electrodes need not, however, be at ground potential.

The arrangement of the insulating members 5,5' and the screen electrodes 10,10' requires no special geometrical shaping of the corona discharge device 7. Further, discharge devices other than a wire or needle corona, if desired with a screen, may be used.

In numerous tests examining the efficiency of the apparatus of the invention, there was used a corona discharge device 7 comprising a series of corona needles contained in a housing open to the recording material to be charged, the housing being made of dielectric material and not containing additional electrodes.

What is claimed is:

1. An electrostatic charging apparatus, comprising a. means for producing a corona discharge;

b. a counter-electrode positioned below the discharge means adapted for supporting a recording material to be charged;

c. means for supporting said counter-electrode, including a pair of opposed vertical side walls defining a guide channel of substantially rectangular cross-section along which the recording material can pass; and d. a pair of elongated strip-like members of electrically insulative material extending within the channel at least from the side walls laterally along the opposed marginal regions of the counter-electrode and longitudinally along the whole length of the counter-electrode.

2. The apparatus as claimed in claim 1, wherein the strip-like insulating members extend into horizontal slots formed in side walls of the guide channel.

3. The apparatus as claimed in claim 1, wherein the counter-electrode extends, in a horizontal direction perpendicular to the side walls, outwardly beyond each strip like member of insulative material.

4. The apparatus as claimed in claim 1, wherein each strip-like member of insulative material extends, in a horizontal direction parallel to the side walls, beyond the edges of the counter-electrode.

5. The apparatus as claimed in claim 1, wherein the counter-electrode comprises a horizontal transparent plate of an electrically insulative material having on its upper surface a transparent electrically conductive layer.

6. The apparatus as claimed in claim 5, further comprising an electrode connectable to a predetermined electrical potential connected to each edge of the conductive layer extending parallel to said side walls.

7. The apparatus as claimed in claim 6, further comprising means for supplying across the conductive layer, via the electrodes, a heating voltage, whereby said conductive layer may be heated.

8. The apparatus as claimed in claim 6, wherein one of said electrodes is grounded.

9. The apparatus as claimed in claim 1, wherein each strip-like member comprises a polyester film.

10. The apparatus as claimed in claim 9, wherein the film has a thickness of about 50 $\mu$m.

11. The apparatus as claimed in claim 1, wherein the width of each strip-like member extending into the channel, measured from its respective side wall, is from about 2 to 5 mm.

12. The apparatus as claimed in claim 1, wherein the discharge means includes a rectangular housing for at least one discharge electrode, two opposed sides of the housing extending parallel to said side walls and a screen electrode located in the lower region of each of said sides of the housing adjacent said side walls.

13. The apparatus as claimed in claim 12, further comprising means provided on each screen electrode for connecting it to a predetermined potential.

14. The apparatus as claimed in claim 1, wherein each side wall comprises an elongate member made of dielectric material and wherein said counter-electrode supporting means comprises means including a pressure member positioned below the counter-electrode for urging the counter-electrode against the elongate members.

15. The apparatus as claimed in claim 14, further comprising one or more members of a resilient material under compression between the pressure member and the counter-electrode.

16. The apparatus as claimed in claim 15, wherein said resilient members are discs.

17. The apparatus as claimed in claim 15, wherein the resilient pressure member is in the form of a rectangular frame.

18. The apparatus as claimed in claim 14, wherein the strip-like members of insulative material are clamped between the counter-electrode and the elongate members.

19. The apparatus as claimed in claim 12, wherein the screen electrodes are arranged so that, in use, they extend substantially above the edges of the recording material.

20. The apparatus as claimed in claim 1, wherein the strip-like insulative members are formed integrally with the side walls.

21. The apparatus as claimed in claim 6, further comprising means for supplying to the conductive layer, via said electrodes, a direct or alternating heating current.

22. A method of processing a recording material, comprising the steps of passing a recording material through the guide channel of the apparatus defined by claim 1 and exposing said material to an electrostatic charge.

* * * * *